US011161032B2

(12) United States Patent
Roehrig

(10) Patent No.: US 11,161,032 B2
(45) Date of Patent: Nov. 2, 2021

(54) BOARD GAME/CHESS GAME

(71) Applicant: ACTIVE OWNERSHIP LP, Limassol (CY)

(72) Inventor: Stefan Martin Roehrig, Vienna (AT)

(73) Assignee: ACTIVE OWNERSHIP LP, Limassol (CY)

( * ) Notice: Subject to any disclaimer, the term of this patent is extended or adjusted under 35 U.S.C. 154(b) by 0 days.

(21) Appl. No.: 16/322,617

(22) PCT Filed: Aug. 3, 2017

(86) PCT No.: PCT/EP2017/069593
§ 371 (c)(1),
(2) Date: Feb. 1, 2019

(87) PCT Pub. No.: WO2018/024803
PCT Pub. Date: Feb. 8, 2018

(65) Prior Publication Data

US 2019/0176021 A1 Jun. 13, 2019

(30) Foreign Application Priority Data

Aug. 3, 2016 (EP) ..... 16182586

(51) Int. Cl.
*A63F 3/00* (2006.01)
*A63F 3/02* (2006.01)

(52) U.S. Cl.
CPC ..... *A63F 3/00574* (2013.01); *A63F 3/00261* (2013.01); *A63F 3/00697* (2013.01);
(Continued)

(58) Field of Classification Search
CPC .. A63F 2003/00255; A63F 2003/00261; A63F 2003/00264–2003/00315;
(Continued)

(56) References Cited

U.S. PATENT DOCUMENTS 2,253,823 A * 8/1941 Suteras ..... A63F 9/20 273/293
2,293,298 A * 8/1942 MacDonald ..... 273/265
(Continued)

FOREIGN PATENT DOCUMENTS

DE 699 473 11/1940
DE 24 52 380 5/1976
(Continued)

OTHER PUBLICATIONS

English machine translation of DE 699,473 C (Year: 1940).*
(Continued)

*Primary Examiner* — Laura Davison
(74) *Attorney, Agent, or Firm* — Greenblum & Bernstein, P.L.C.

(57) ABSTRACT

Board game (1) with a board (2) having at least one playing surface (3) comprising multiple playing fields (4) and with playing pieces (5) and at least one holding device (6) for holding a playing piece (5) releasably attached to the playing field (4), with the board (2) being arranged such that the orientation of the playing surface (3) deviates from a horizontal orientation, wherein a rotating device (7) is provided for holding the playing piece (5) in a same vertical orientation for any rotation of the board (2) about an imaginary axis (A) substantially orthogonally to the playing surface (3).

19 Claims, 9 Drawing Sheets

(52) U.S. Cl.
CPC ..... *A63F 3/02* (2013.01); *A63F 2003/007* (2013.01); *A63F 2003/0041* (2013.01); *A63F 2003/0063* (2013.01); *A63F 2003/00302* (2013.01); *A63F 2003/00406* (2013.01); *A63F 2003/00435* (2013.01); *A63F 2003/00577* (2013.01); *A63F 2003/00583* (2013.01)

(58) Field of Classification Search
CPC ..... A63F 3/00574; A63F 2003/0058; A63F 2003/00611; A63F 2003/00697; A63F 3/02–3/027; G09F 7/02–2007/127
See application file for complete search history.

(56) References Cited

U.S. PATENT DOCUMENTS 2,454,639 A * 11/1948 Edwards ..... A63F 3/027 273/282.1
2,873,938 A * 2/1959 Crawford, Jr. ..... A63F 3/0423 273/280
3,128,098 A * 4/1964 Kolenda ..... A63F 3/00261 273/281
3,178,185 A * 4/1965 Ardis ..... A63F 3/00261 273/273
3,751,039 A * 8/1973 Dykoski ..... A63F 3/00697 273/260
3,895,804 A * 7/1975 Lee ..... A63F 3/00574 273/242
3,904,206 A 9/1975 Kolwicz
3,926,437 A * 12/1975 Moe ..... A63F 3/08 273/260
4,243,223 A * 1/1981 Ver Hoef ..... A63F 11/0011 273/141 R
4,348,027 A * 9/1982 Escamilla-Kelly ..... A63F 3/00214 273/241
4,529,206 A 7/1985 Curry et al.
5,040,800 A * 8/1991 Ulan ..... A63F 3/00574 273/239
5,275,401 A * 1/1994 Llorens ..... A63F 7/068 273/108.51
5,503,400 A 4/1996 Silva
6,189,885 B1 * 2/2001 Hamot ..... A63F 7/068 273/108.1
6,345,822 B1 2/2002 Reynolds
6,409,169 B1 * 6/2002 Sutter ..... A63F 7/06 273/108.1
6,450,497 B1 * 9/2002 Bialler ..... A63F 7/0684 273/108.1
7,147,225 B2 * 12/2006 Navarro ..... A63F 7/06 273/242
7,325,803 B1 * 2/2008 Miranda ..... A63F 7/0668 273/108.41
7,931,520 B2 * 4/2011 Bryce ..... A63H 17/262 446/444
8,876,113 B2 * 11/2014 Dolk ..... G09B 19/22 273/260
2005/0062225 A1 * 3/2005 Tien ..... A63F 7/0672 273/108.51
2014/0000136 A1 * 1/2014 Wu ..... H05K 5/0252 40/606.15

FOREIGN PATENT DOCUMENTS

WO 99/08760 2/1999
WO 2004/037361 5/2004
WO 2007/102179 9/2007

OTHER PUBLICATIONS

Int'l Search Report (Form PCT/ISA/210) conducted in Int'l Application No. PCT/EP2017/069593 (dated Nov. 6, 2017).
Written Opinion (Form PCT/ISA/237) conducted in Int'l Application No. PCT/EP2017/069593 (dated Nov. 6, 2017).
Europe Search Report conducted in Europe Appln. No. EP 16 18 2586 (dated February 6, 3017).

* cited by examiner 1
2
T2
T5
5
B5
3
B2

1
2
T2
T5
B5
B2

1
2
T5
B2
B2
T2

1
2
B2
T5
B5
T2

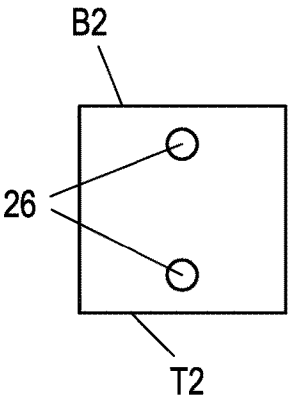
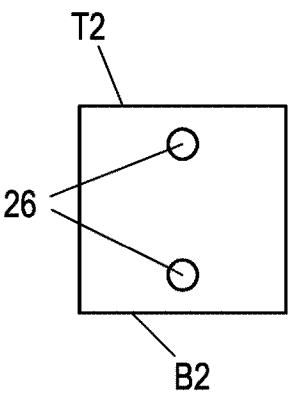
Fig. 19b
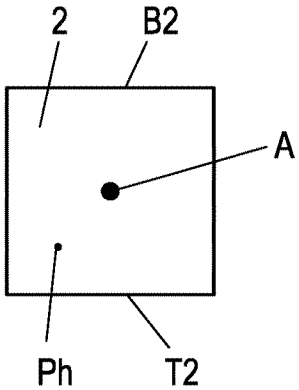
Fig. 19a
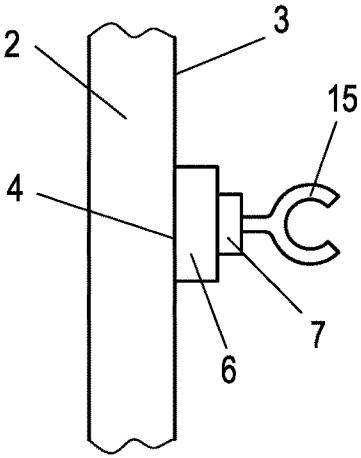
Fig. 12
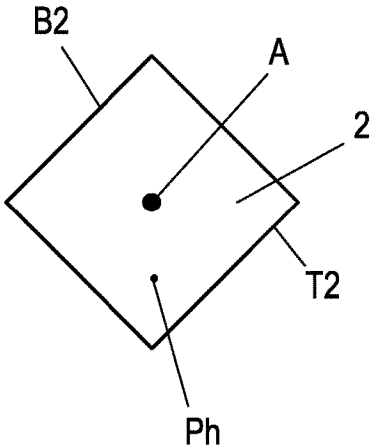
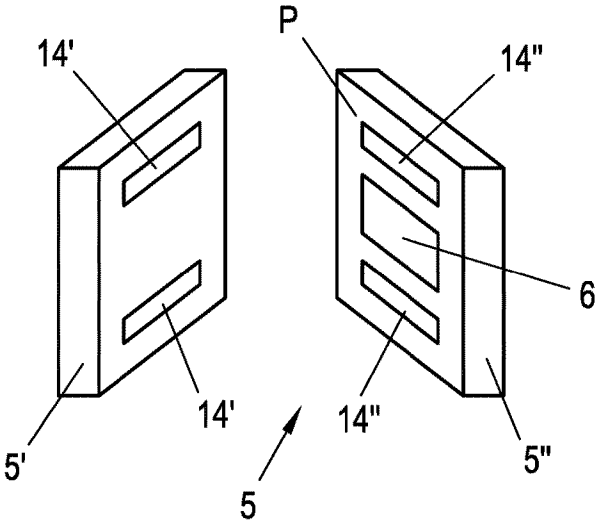
Fig. 11
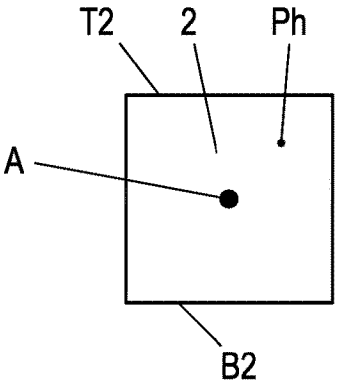

BOARD GAME/CHESS GAME

CROSS-REFERENCE TO RELATED APPLICATIONS

The present application is a U.S. National Stage of International Patent Application No. PCT/EP2017/069593 filed Aug. 3, 2017, and claims priority under 35 U.S.C. §§ 119 and 365 of Europe Patent Application No. EP 16182586.4 filed Aug. 3, 2016, the disclosures of which are expressly incorporated by reference herein in their entireties.

BACKGROUND OF THE INVENTION

1. Field of the Invention

The invention relates to a board game with a board having at least one playing surface comprising multiple playing fields and with playing pieces and at least one holding device for holding a playing piece releasably attached to the playing field, with the board being arranged such that the orientation of the playing surface deviates from a horizontal orientation.

2. Discussion of Background Information

Board games as described above, played by at least two players, are known in the state of the art. The boards may be arranged in horizontal or vertical orientation for playing the game. In horizontal orientation of the board the considered game is played by players typically facing each other and the playing pieces are moved mainly in different directions, away from each player. When the board is oriented vertically holding devices are foreseen that hold the playing pieces releasably at the assigned playing fields, such that the playing pieces can be released from the board by the player and placed on a different playing field or even replaced at the same playing field without falling off the playing field unintentionally. Thus the playing pieces are held reliably and releasably at the vertical oriented playing surface in playing position for the duration of the game.

U.S. Pat. No. 5,503,400 discloses a chess set permitting chess to be played with the chess board in a vertical position, removably mounted on a wall, and in a horizontal position. The chess pieces are bisected and rejoinable by a tongue and a groove. For holding the chess pieces on the playing surface in vertical position one halve of each chess-piece has a magnet, and the chess board is a magnetic receptor, such that the part of the chess piece comprising the magnet is held on the chess board by magnetic force.

U.S. Pat. No. 5,040,800 discloses a board game with playing pieces that can be moved on a playing surface of the board, which is vertically disposed. The playing pieces are releasably held in their assigned positions by magnets or projections.

U.S. Pat. No. 3,926,437 discloses a game with playing pieces and a playing board comprising a grid-like arrangement of playing areas and oriented vertically. The playing pieces can be moved and rotated manually by the player.

U.S. Pat. No. 3,904,206 discloses a game apparatus for playing chess on a vertical oriented board comprising horizontal supporting surfaces for supporting the game pieces.

The board games mentioned above are designed to play the game on a board disposed vertically, which in some cases can also be arranged in horizontal position. While in horizontal position of the board two players may play the game from opposite positions in opposing directions, the same board positioned vertically requires both players to play the game essentially from a similar position. Although this typically doesn't pose any limitation to the player playing upwards, from the bottom to the top, this arrangement may cause difficulties to the other player playing downwards. A reason might be that humans are accustomed to playing on a horizontal playing field taking a viewpoint directly opposite of their opponent.

The known board games do not provide a solution to overcome this drawback in simple manner, as long as the boards are disposed vertically or at least such that the orientation of the playing surface deviates from a horizontal orientation, with the playing figures arranged on the board.

SUMMARY

It is therefore an object of the invention to provide a board game as initially mentioned with a vertically oriented board, or with a board being arranged such that the orientation of the playing surface deviates from a horizontal orientation, that allows all players to play the game in the same direction, preferably upwardly, while the game pieces are still moved mainly in opposing directions, like on a board being placed horizontally, without a burden for the players to re-orient the playing pieces, positioned upside down or at any other confusing angle in case of rotating the vertically arranged board. The playing pieces shall be held reliably at the board while the board game can be produced cost-efficiently. Furthermore the board and the playing pieces shall comprise pleasant visual appearance.

For this purpose, the invention provides a board game as defined in claim 1. Advantageous embodiments and further developments are indicated in the dependent claims.

The board game according to the invention is designed to be played typically by two or more players starting their moves from different, in particular opposing positions on the board, which board is arranged such that the orientation of the playing surface deviates from a horizontal orientation, e.g. the board being arranged vertically, and the playing pieces are mainly moved in opposing directions on the board. It shall be noted that neither the board nor the playing pieces have to be oriented exactly or only vertically. If for simplification the specification refers to a vertical orientation, this orientation shall be understood as possibly comprising also a component in horizontal direction. In this specification a reference to a vertical orientation of the board shall therefore include a board tilted or inclined with respect to a horizontal plane on which horizontally oriented board games are typically played, i.e. it shall include a board being arranged such that the orientation of the playing surface deviates from a horizontal orientation. For instance the board may be arranged at an angle between 15° and 120°, more preferred between 45° and 100°, in particular at approximately 75° to a horizontal plane, to provide more comfort to the players if desired. Furthermore, in this specification, a reference to a vertical orientation of the playing pieces shall include playing pieces tilted or inclined with respect to a vertical plane. The board of the game comprises at least one playing surface with multiple playing fields and one or more playing pieces can releasably be held at each playing field by one or more holding devices. Preferably although not necessary each playing field can be assigned with one playing piece, held by one holding device. The holding device can be arranged on or in or behind a playing field of the board or on or in a playing piece or both on or in or behind a playing field of the board and on or in a playing piece. The holding device protects the releasable playing piece from falling off the vertical oriented board although the playing pieces can be moved on the board. An exemplary board game can be a strategy game. In order to allow the players to move the playing pieces essentially in the same direction from the players view, preferably upwardly, the board of the board game can be rotated about an imaginary axis, which axis is arranged substantially orthogonally to the playing surface of the board. The playing pieces held in their assigned positions on the board are of a design familiar to the players and comprise a top end and a bottom end, which bottom end faces downwards. In order to avoid the playing pieces held on the board and rotated together with the board ending up upside down or at any other angle that may confuse the players, at least one rotating device is provided for holding at least one playing piece in the same vertical orientation when the board is rotated. For instance a single rotating device may be provided for holding some or all playing pieces in a same vertical orientation, or one rotating device may be provided for each playing piece to be held in a same vertical orientation. Preferably all playing pieces are held in a same vertical orientation. The rotating devices ensure that the playing pieces keep their typical vertical orientation independent of the angle of rotation of the board. The board can thus be rotated between the moves of different players to allow all players to move their playing pieces essentially in the same direction without getting confused by playing pieces arranged at unusual orientations and without the burden to reorientate the playing pieces manually to avoid such confusion.

Within this specification the rotation of the board is not limited to a rotation about an axis orthogonally to the playing surface of the board. Instead the board may be rotated in any way or flipped to end up essentially upside down or in any other rotated orientation. Therefore in this specification the term "rotation" includes all movements of the board changing the orientation of the board as if the board was rotated about an imaginary axis, which axis is arranged orthogonally to the playing surface of the board. In particular the term "rotation" includes rotation about any axis or flipping the board.

The terms horizontal, vertical, top, bottom, upwards, downwards and behind refer to orientations, positions or directions as viewed by the players when playing the game.

In accordance with an advantageous embodiment of the invention, the rotating device comprises a rotating part rotating about a rotation axis and connected to the playing piece or to the holding device or to the playing field of the board and comprises a bearing for rotating the rotating part, in particular a radial bearing. The bearing assures reliable rotation of the rotating part and therefore of the playing piece as well as a stable arrangement of the playing piece at the board or playing field respectively, i.e. undesired vibration of the playing piece in a direction essentially parallel to the playing surface can be avoided to a large extent. Preferably the rotating device comprises a non-rotating or fixed part respectively, opposite the rotating part.

In a preferred low cost embodiment the radial bearing comprises a pin rotating in a bore hole or in a sleeve. The radial bearing can be constructed to avoid undesired separation of the pin and the bore hole or sleeve. The bore hole can be part of and the sleeve can be connected to the components rotated by the rotating device while the pin is at least part of the opposite non rotating part of the rotating device or vice versa.

In accordance with a further embodiment of the invention, the centre of gravity of all rotating components connected to or part of the rotating part, including the playing piece, does not coincide with the rotation axis in order to hold the playing piece in a same vertical orientation by gravity. As the centre of gravity of all components or bodies, including the playing piece, excepting the board, rotated by the rotating device is not located on the rotation axis of the rotating device or of its rotating part, the playing piece is rotated about the axis, when the board is rotated, without any further manual interaction by the players. The rotating device therefore works as self-acting rotating device. In addition to the benefit that the playing pieces rotate automatically by gravity to keep their usual vertical orientation when held at the rotated board, this embodiment can be manufactured particularly with small dimensions, at low cost and at low weight. In particular the small dimensions of the rotating device allow for a pleasant appearance of the board game.

In order to support the rotating operation at least one of the playing piece, the holding device and the rotating device may comprise a weight element. The weight element can be a separate component added to the playing piece, the holding device or the rotating device, or it may be an integral part of them. In particular when the playing piece, the holding device and/or the rotating device are of low weight the weight element may help in overcoming frictional forces occurring in the rotating device and thereby ensure reliable rotation of the playing pieces. The weight of the weight element may be between a few gram and more than 1 kg and it may be in particular in the range between 5 g and 2 kg, more preferably between 10 g and 1 kg, depending on the weight of the playing piece, the holding device and/or the rotating device.

If the rotating device is arranged within or attached to the playing piece, i.e. the rotating device is in contact with the playing piece and the board is free of the rotating device, the board of the board game doesn't need to be modified for arranging the rotating device and can therefore keep a pleasant appearance. This is beneficial in particular if the board shall also serve as decorative element, with or without the playing pieces assigned to the board. The rotating device can be accommodated completely within the playing piece, e.g. in that the rotating device comprises an outer ring and an inner ring, with the outer ring rotating around an inner ring, which inner ring is fastened to the holding device by a pin. In an other one of several possible embodiments a sleeve of the rotating device can be attached to the playing piece, e.g. on its surface, and a pin of the rotating device can be inserted into the sleeve and fastened to the holding device.

If however the rotating device is arranged on or within the board, i.e. the rotating device is in contact with or arranged within the board and the playing piece is free of the rotating device, unmodified standard playing pieces keeping their pleasant appearance can be rotated by the rotating device. It is therefore possible to play the game with different sets of playing pieces, without the effort to modify all of them, or with playing pieces which are difficult to modify due to their shape or the material they are made of.

Advantageously the rotating device comprises a bore hole or a sleeve in the playing field of the board. The bore hole, in particular the inner wall of the bore hole, or the sleeve are at least part of the non-rotating fixed part of the rotating device, within which fixed part the rotating part of the rotating device is accommodated. The effort for drilling a bore hole and eventually inserting a sleeve in every playing field at which a playing piece shall rotate is particularly small.

Alternatively the rotating device may comprise a circular ring or a circular disk accommodated in a part of the board associated with the playing field in rotating manner. The circular ring can be accommodated in a circular groove built at the playing surface of the playing field, down in the board, and is able to rotate within the groove. In order to hold the circular ring reliably in the groove, the groove preferably widens in a direction away from the playing surface so that the width of the groove at the playing surface is smaller than the width of the ring. The circular disk may also be accommodated within the board in rotating manner, in particular within a circular recess built in the board. The circular disk may be covered in part by the playing surface or a playing field respectively, which in this case comprise an opening, e.g. in the form of a bore hole or circular ring, for connecting the playing piece to the circular disk.

In order to avoid any modification of the board for arranging the holding device it is beneficial that the holding device is arranged on the playing piece only and preferably comprises one of an adhesive element, an electrostatically loaded element or a suction cup. The suction cup provides connection using under-pressure whereas the suction can be produced by just pressing the playing piece on the board or by some form of handle that increases the volume inside the cup, or with electro magnets. Of course the connecting or holding devices are not limited to those mentioned and alternative connecting or holding devices, which need to be provided on the playing piece only, i.e. which don't need a counter element to be attached at an element different to the playing piece, may be used. Examples are connections used for "sticky pads" that hold on car dashboards, or reusable adhesives like "Post-it® notes", or connections that use the gecko effect like "Geckskin™ pad". The holding device not requiring a counter element shall on the one hand allow for reliable attachment of the holding device and therefore of the playing piece on the playing surface and on the other hand for simple removal of the playing piece without excessive forces. Thereby the holding device can be releasably stuck, sucked or differently releasably attached to the playing surface.

In another preferred embodiment it may be provided that the holding device is arranged on or in the playing piece and connected to the playing field of the board and comprises one of a magnet/magnetizable element connected to the playing piece interacting with a magnetizable element/magnet connected to the playing field, hook and loop fastener connected to the playing piece and on the playing field or a pin connected to the playing piece/playing field inserted into a bore hole or sleeve in the playing field/playing piece. In case of using a combination of a magnet and a magnetizable element, e.g. a ferromagnetic element, it is of advantage to connect the magnet to the playing piece and to arrange the magnetizable element, e.g. a metal sheet, at the board, preferably behind the playing surface, e.g. at the back side of the board. Of course the magnet can alternatively be arranged on the board and the magnetizable element on or connected to the playing piece. The magnetic forces acting between the magnet and the magnetizable element can hold the playing piece at the assigned playing field and allow its simple removement. Instead of a magnet and a magnetizable element hook and loop fastener can be used comprising, as is commonly known, two parts which can be stuck to and released from each other. When one of the two parts is connected to the playing piece the other of the two parts is arranged on the playing field of the board. In an other alternative a pin connected to the playing piece can be inserted into a bore hole or sleeve in the board at the position of the playing field or the pin is arranged on the board, in particular at the playing field, and engages a bore hole or sleeve in or connected to the playing piece. The inner diameter of the bore hole or the sleeve and the outer diameter of the pin are designed to hold these two parts releasably together by gripping force.

If the holding device is arranged on or in the playing field of the board only and comprises a platform for supporting a playing piece, the platform being connected to the playing field of the board at an angle different to 0° between the platform and the playing field, unmodified playing pieces can be used to play the board game on the vertically oriented board. In this case each platform serves e.g. as essentially horizontal supporting surface, arranged orthogonally to the playing surface, at which platform a playing piece may be positioned. The platform doesn't need to be oriented exactly parallel to a horizontal plane, i.e. it may be inclined with respect to a horizontal plane. The platform may also be arranged non-orthogonally, i.e. tilted, with respect to the playing surface. In particular the platform may support a playing piece selected from different sets of playing pieces comprising different size and shape. This embodiment is particularly beneficial if the playing pieces are made of expensive material. In order to avoid the playing pieces unintentionally falling off the platform, a fastening device e.g. comprising magnetic elements or adhesives or hook and loop fasteners or other connecting elements described above may be provided on the platforms and/or on the playing pieces, if simple modifications essentially at the base of the playing pieces are acceptable. Modifications at the base of the playing pieces can be avoided if the fastening devices are provided on the platforms only.

Preferably the platform of the holding device is connected to a first leg via a second leg, the first leg being arranged at the playing field, preferably at the centre of the playing field, in rotating manner in a bore hole or in a sleeve in the playing field of the board. The first leg may be arranged orthogonally to the second leg which may be arranged e.g. orthogonally to the platform. This construction, comprising e.g. a z-shaped holding device, ensures both that the playing piece is held reliably at the playing field and that the playing piece can be held in a same vertical orientation if the board is rotated in a vertically oriented plane or a plane comprising a vertical component. As the first leg is connected to or part of the rotating device, which comprises the bore hole or sleeve, the first leg may rotate in the bore hole or sleeve and thereby the holding device supporting the playing piece can rotate about the middle axis of the first leg.

In another preferred embodiment of the invention the platform of the holding device is connected to the circular ring or to the circular disk of the rotating device in order to hold the playing piece reliably at the playing field and in a same vertical orientation if the board is rotated in a vertically oriented plane or a plane comprising a vertical component. The circular ring or circular disk accommodated in the part of the board associated with the playing field in rotating manner and the platform e.g. arranged horizontally are connected to each other firmly.

In accordance with another advantageous embodiment of the invention, the playing field is a rotatable element, the rotatable element being connected to the board by the rotating device. In this case the playing fields are not printed or otherwise differently fixed directly on a surface of the board. Instead at least one playing field is connected to the board in rotating manner and the playing piece is releasably connected to the respective playing field by the holding device.

If the rotatable element comprises circular shape, the rotatable element, i.e. the playing field, may rotate without hitting an adjacent rotatable element comprising circular shape as well.

In order to provide a playing surface comprising familiar appearance, the rotatable element may comprise rectangular or squared shape. In this case adjacent rotatable elements may be designed small enough to not hit each other when rotating. In particular the diagonal extension of the rotatable element is not larger than the distance between the rotation axes of adjacent rotatable elements.

In an alternative embodiment the rotatable elements arranged next to one another, preferably in rows or in columns, are arranged at different distances to the board, so as to rotate without contacting each other. This embodiment provides a playing surface with playing pieces arranged e.g. in rows or columns but not provided in a single plane. In this case the rotatable elements may be of a size requiring no gap between the borders facing each other of adjacent rotatable elements when viewed from the front of the board. I.e. as seen from the players point of view, adjacent rotatable elements may appear as having boarders touching each other. In particular the diagonal extension of the rotatable element may even be larger than the distance between the rotation axes of adjacent rotatable elements.

In order to provide a different view onto the playing pieces it can be provided that the playing piece comprises a vertical axis and being held by the holding device at an angle different to 0° between the playing surface and the vertical axis. In this way the playing piece is arranged in non-parallel manner to the playing surface. The view onto the playing pieces determined by the angle between the vertical axis of the playing piece and the players line of view may be pleasant to the players. The vertical axis extends from the bottom to the top of the playing piece independent of the orientation of the playing piece.

Instead of rotating the playing piece by gravity it may be provided that a motor or a gear-wheel drive is connected to the rotating device for driving it. The motor, e.g. an electric motor like a step motor, may be actuated by the players to turn the playing piece to which the motor is connected via the rotating device. The motor can be designed to rotate only by 180° to the left and to the right, when triggered by the players, or it may rotate as long as the players keep it activated, e.g. by pressing a button. The electric motor may be driven by a battery or a mains supply, and it may be connected to at least one sensor detecting the orientation of the board and/or of the playing piece(s), so that upon rotating the board the playing piece(s) is/are rotated for holding the playing piece(s) in a same vertical orientation. If alternatively a gear-wheel drive is connected to the rotating device a gear wheel may be attached firmly to the board, so as to rotate with the board, and engage an other gear wheel rotating around a fixed axis, which other gear wheel is connected to the rotating device. Therefore rotation of the board causes rotation of the playing piece via the engaged gear wheels and the rotating device.

According to a preferred embodiment the playing piece is mounted to the holding device in the angular relationship or the playing piece comprises an inclined base to be supported by the platform, e.g. arranged essentially horizontally, or the platform is arranged non-orthogonally with respect to the playing surface. Several constructions can be used to mount the playing piece to the holding device in the angular relationship. For instance, in vertical position of the board, the holding device may comprise a horizontal pin which engages a bore hole or sleeve in the playing figure, which bore hole or sleeve is arranged non-orthogonally to the vertical axis of the playing piece. Alternatively the pin may be arranged non-orthogonally with respect to the playing surface and the bore hole or sleeve in the playing figure is arranged orthogonally to the vertical axis of the playing piece. If the holding device comprises a horizontal platform the playing piece can be designed with an inclined base, i.e. the angle between the plane of the base and the horizontal platform is different to 0°. In an other variant the platform for supporting the playing piece and sometimes referred to as horizontal platform above may be arranged at an angle different to 90° with respect to the playing surface.

In order to allow the playing piece, comprising at least a part of the holding device, to optionally look like an unmodified playing piece without a holding device, used typically when playing the board game on horizontal game boards, it is beneficial if the playing piece is built of two halves separable from and connectable with each other along a vertical mid-plane of the playing piece, wherein one of the two halves representing the playing piece to be held in a same vertical orientation. The playing piece built of two halves can therefore be used in assembled condition on horizontal game boards while after disconnecting the two parts the half part of the playing piece comprising at least the part of the holding device may be arranged on the vertical game board. For instance the two halves may be connected with each other by clamping means or magnet/magnetizable elements, whereas the magnet can be used as the holding means or as part of the holding means to the board too.

The board game can be designed in different shape and size but it is preferred that the perimeter of the board and/or the playing surface is rectangular or square with a length of their side edges in the range of 10 cm to 3 m, preferably 20 cm to 1 m. Depending on its size the board game may be played preferably in private living spaces or in comparatively larger public rooms, e.g. in hotels for amusement of the hotel guests or at competitions with audience. The area surrounded by the perimeter of the board and the area surrounded by the perimeter of the playing surface may be of the same size and shape, although this is not necessary.

For playing the board game outdoors it is beneficial if the board and the playing piece are built to be water-resistant. In particular the board and the playing piece may comprise a water-resistant coating or they may be made of water-repellent material or material without water absorption.

If the players prefer to play the board game with unmodified playing pieces, i.e. playing pieces without a holding device or part of a holding device mounted thereon, the playing piece may be removably connected to the rotating device, preferably by a clamping element on the rotating device. Accordingly the playing piece can be clamped to the rotating device or alternatively to at least a part of the holding device and removed if desired.

In order to avoid the playing piece to be stolen, e.g. when playing the board game in a public area, the playing piece may be connected to the board not fully removable, which connection still allows for movement of the playing piece, i.e. for holding a playing piece releasably at the playing field. A very simple connection comprises a thin chain or cord. Alternatively, instead of avoiding removement of the playing piece, a distance detecting device, initiating an audible and/or visible alarm signal when the distance between the board and the playing piece exceeds a predefined threshold may be provided on the board and on the playing piece. For instance the board and the playing piece may be provided with an RFID (Radio Frequency Identification) or NFC (Near Field Communication) system for comparing the distance between a transponder on or in the playing piece and a reading device on or in the board.

A preferred embodiment for connecting the playing piece to the board not fully removably, may be characterised in that the board at the playing surface comprises channels along which the playing piece can be moved and the holding device comprises a pin engaging the channels with a counter element at an end of the pin, the diameter of the counter element being larger than the width of the channels. The channels which extend from within the board to the playing surface are designed to extend along the playing fields and may be arranged between the centres of the playing fields so that the playing piece can be moved between the playing fields. Alternatively the channels may extend along the edges of the playing fields and from the edge to the center of the playing field on one or more sides. This allows moving a playing piece over playing fields that are occupied by other playing pieces without the need for moving the other playing pieces. Because of the counter element, at the end of the pin or holding device opposite the playing piece, which counter element comprises a thickened part which can not pass through the channels, the playing piece connected to the pin can not be removed from the board.

In a very simple embodiment the board may be rotated or otherwise reoriented manually by the players without a device for rotating the board. Furthermore the board may be leaned against a wall, including an angle with the wall different to 0°, making fastening means for fastening the board to a wall unnecessary.

According to another preferred embodiment of the invention the board may comprise fastening means for fastening the board to a wall, in particular a vertical wall. In order to allow the board to be positioned upside down or at any other useful angle of rotation, the fastening means may be arranged at least on two side edges of the board, e.g. on two opposing side edges of the board. The fastening means may be adopted to hang the board at a wall or any other suitable vertical structure e.g. by providing one or more hooks on different side edges of the board or by providing one or more hook receiving elements on different side edges of the board when hooks are fastened to the wall or vertical structure.

The board can be rotated easily if the fastening means comprises a supporting device mounted to the wall and a second rotating device connecting the board to the supporting device in rotatable manner. The supporting device may be mounted to the wall releasably or permanently and it comprises a first part of the second rotating device while the board comprises a cooperating second part of the second rotating device, the second part being connected to the first part and being able to rotate with respect to the first part. Alternatively the supporting device comprises the first and the second part of the second rotating device. For assisting and/or guiding the rotation of the board a bearing, e.g. a ball bearing, and/or guiding elements may be arranged in the second rotating device or at any other location between the board and the supporting device.

If the fastening means comprises at least one magnetic element on the board or on the supporting device, the board or the supporting device may be held on a metallic surface, which is part of the wall or vertical structure, by magnetic force. The supporting device may comprise one or more magnetic elements on the back side facing the metallic surface. Also the second rotating device may comprise one or more magnetic elements on the front side facing the board. Alternatively the board may be held on the wall or vertical structure by magnetic elements without providing a supporting device, in which case the board may be taken off the wall or vertical structure before rotating the board.

According to another embodiment the board may be rotated by an electric motor driven by a battery or a mains supply, which is rotating the board by the press of a button or by adjustable time interval. Said button can be connected to a timer that times the thinking time of the players, like a chess clock. In another variant the board may be connected to a torsional spring which after the board has been rotated and locked in its rotated orientation by a locking mechanism rotates the board back autonomously upon releasing the locking mechanism e.g. by the players.

The rotation device of the board may also comprise or be connected to one or more counters that count the number of times the board was turned since it has been hung up or since the game has started. In particular one counter may be provided which can be reset and counts how often the board has been rotated while playing a single game and another counter may be provided which counts how often the board has been rotated since the board has been used the first time.

In order to support the players in rotating the board to defined positions, e.g. to align a bottom edge of the board parallel to a horizontal plane, the board and/or the wall to which the board may be mounted may comprise auxiliary means like latch mechanisms, snap mechanisms or magnets.

In order to allow audience to watch the game, e.g. from the backside of the board opposite the players, the board may comprise transparent material. In particular the board may be made of glass or plastic material.

The board game may be a chess game, accordingly the playing pieces may be chess pieces and the board may be a chess board. In an other example the board game may be a backgammon game, accordingly the playing pieces may be backgammon pieces and the board may be a backgammon board. Particularly chess boards and chess pieces often serve as decorative elements which should remain as unmodified as possible to keep their pleasant appearance. When playing the chess game, rotating the board together with chess pieces fixed thereto without a rotating device would confuse the players as chess pieces have a well known design, particularly a top end and a bottom end. The rotating device according to the invention ensures that the playing pieces are held in a same vertical orientation when the board is rotated. The playing pieces, e.g. chess pieces, may be designed to be rotationally symmetric about their vertical axis or they may be designed to look like a 2-dimensional, flat representation of a rotationally symmetric design.

The rotating device may be provided for holding at least one playing piece in a same vertical orientation, however it is beneficial if all playing pieces are connected to the/a rotating device.

BRIEF DESCRIPTION OF THE DRAWINGS

The invention will be explained in more detail in the following by means of preferred, non-restricting embodiments with reference to the drawings. There is shown in:

FIG. 11 illustrates a playing piece built of two halves separable from and connectable with each other;

FIG. 12 illustrates a rotating device with a clamping element;

FIG. 19*a* illustrates a schematic front view of a board rotated about a physical axis offset from an imaginary middle axis of the board; and FIG. 19*b* illustrates a schematic front view of a board without a physical axis for rotation.

DETAILED DESCRIPTION

The invention will be further explained using the example of a chess game, although the board game according to the invention is not limited to a chess game.

Figure 1A:
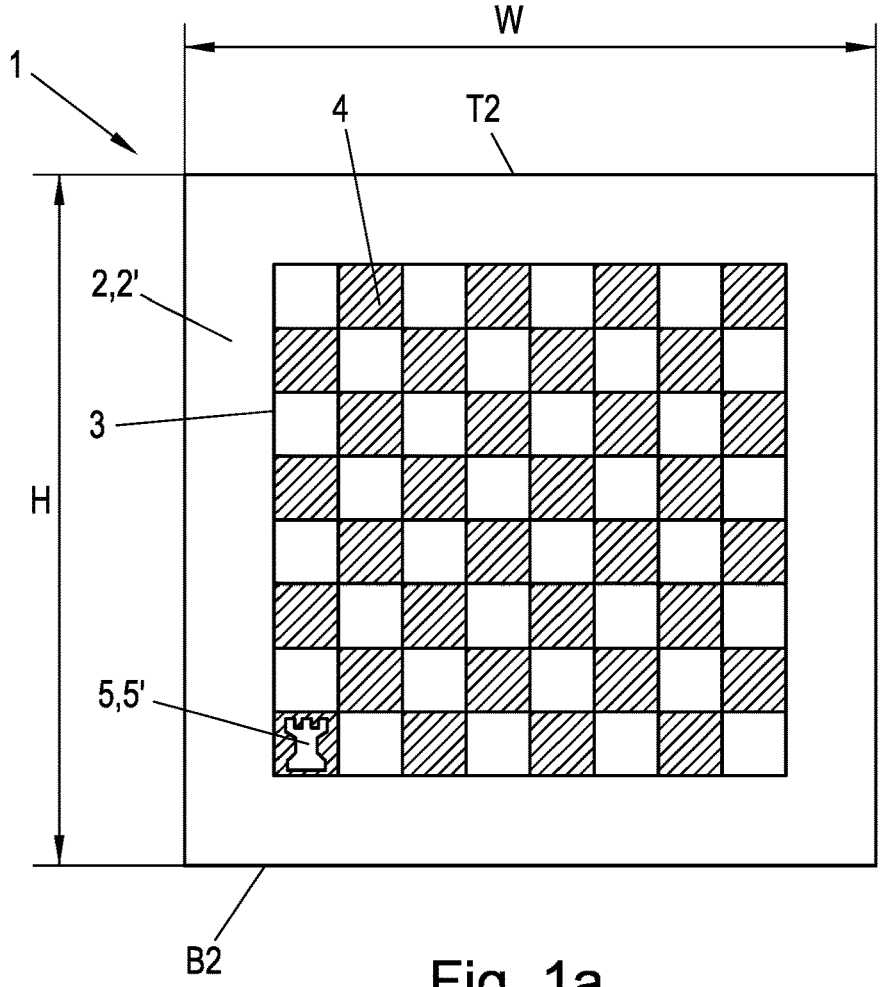
FIG. 1*a* illustrates a board game according to the invention with a playing piece.

FIG. 1*a* shows a board game 1 with a board 2, in particular a chess board 2', having a top side T2, a bottom side B2 and a playing surface 3 comprising multiple playing fields 4, and with a playing piece 5, in particular a chess piece 5'. Although in a typical board game according to the invention more than one playing pieces 5 will be used, FIG. 1*a* shows a single playing piece 5 for illustrative purposes. The board game 1 is designed for allowing one or more players to move the playing pieces 5 over the playing surface 3 and for arranging each playing piece 5 at a playing field 4 selected by the players without the playing pieces 5 releasing unintentionally from the playing fields 4. In order to hold the playing pieces 5 releasably at their assigned playing fields 4 a holding device 6 is provided at each playing field 4 and/or at each playing piece 5. Each holding device 6 may therefore be arranged on a playing field 4 of the board 2, on a playing piece 5 or both on a playing field 4 and on a playing piece 5. For holding the playing pieces 5 in a same vertical orientation for any rotation of the board 2 about an imaginary axis A (see FIG. 15) oriented in this example orthogonally to the playing surface 3, with the board 2 arranged in this example in vertical orientation, a rotating device 7 is provided at each playing field 4 and/or at each playing piece 5, see for instance FIG. 1*d*.

The board 2 shown in FIG. 1*a* comprises two horizontal edges W and two vertical edges H or sides respectively, which may be of a length in the range of 10 cm to 3 m, preferably 20 cm to 1 m. The perimeter U of board 2 and/or the playing surface 3 is of rectangular or square design in this example.

Figure 1B:
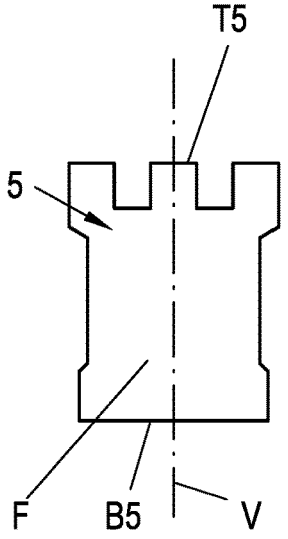
FIG. 1*b* illustrates the front side of a playing piece.

FIG. 1*b* shows the front side F of a playing piece 5, which front side F is the side seen by a player when playing the board game 1. Front sides F are often designed for providing pleasant visual appearance and are typically free from the holding devices 6 and rotating devices 7, which are therefore arranged on the back side B of the playing pieces 5, as can be seen in FIG. 1*c*. In the example of FIG. 1*b*, 1*c* the playing piece 5 is of flat design, representing a two dimensional appearance of a playing piece 5 and it comprises a top end T5, a bottom end B5 and a vertical axis V. Of course, playing pieces 5 of any other shape may be used with the board game 1.

Figure 1D:
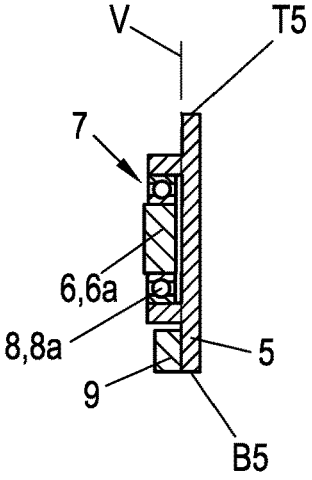
FIG. 1*d* illustrates a cross sectional side view of the playing piece of FIG. 1*b;*
Figure 1C:
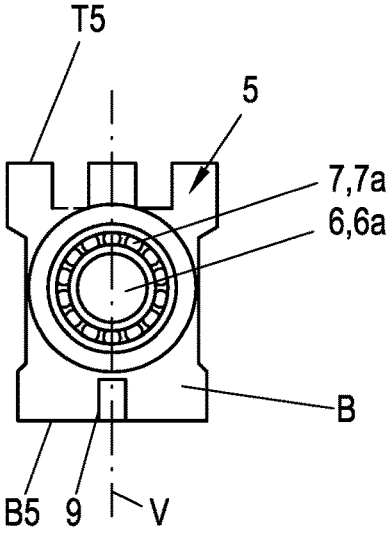
FIG. 1*c* illustrates a back side of the playing piece of FIG. 1*b;*

FIG. 1*d* shows a cross sectional view of the exemplary playing piece 5, which is connected to a magnet 6*a* and to a rotating device 7 comprising a bearing 8, in particular a ball bearing 8*a*. The magnet 6*a* and magnetizable elements 6*a'* (see FIG. 3*a*) in or on or behind board 2 together represent the holding device 6. The magnetizable elements 6*a'* may be a metal plate at the board 2 or magnetizable pieces, e.g. metallic chips or powdered metal, within the board 2. The holding device 6 holds the playing piece 5 at the playing field 4 assigned by the player while the playing piece 5 can rotate around the magnet 6*a* which is part of the holding device 6. In order to support the rotation of playing piece 5, a weight element 9 is arranged on the playing piece 5.

Figures 2A, 2B, 2C, 2D:
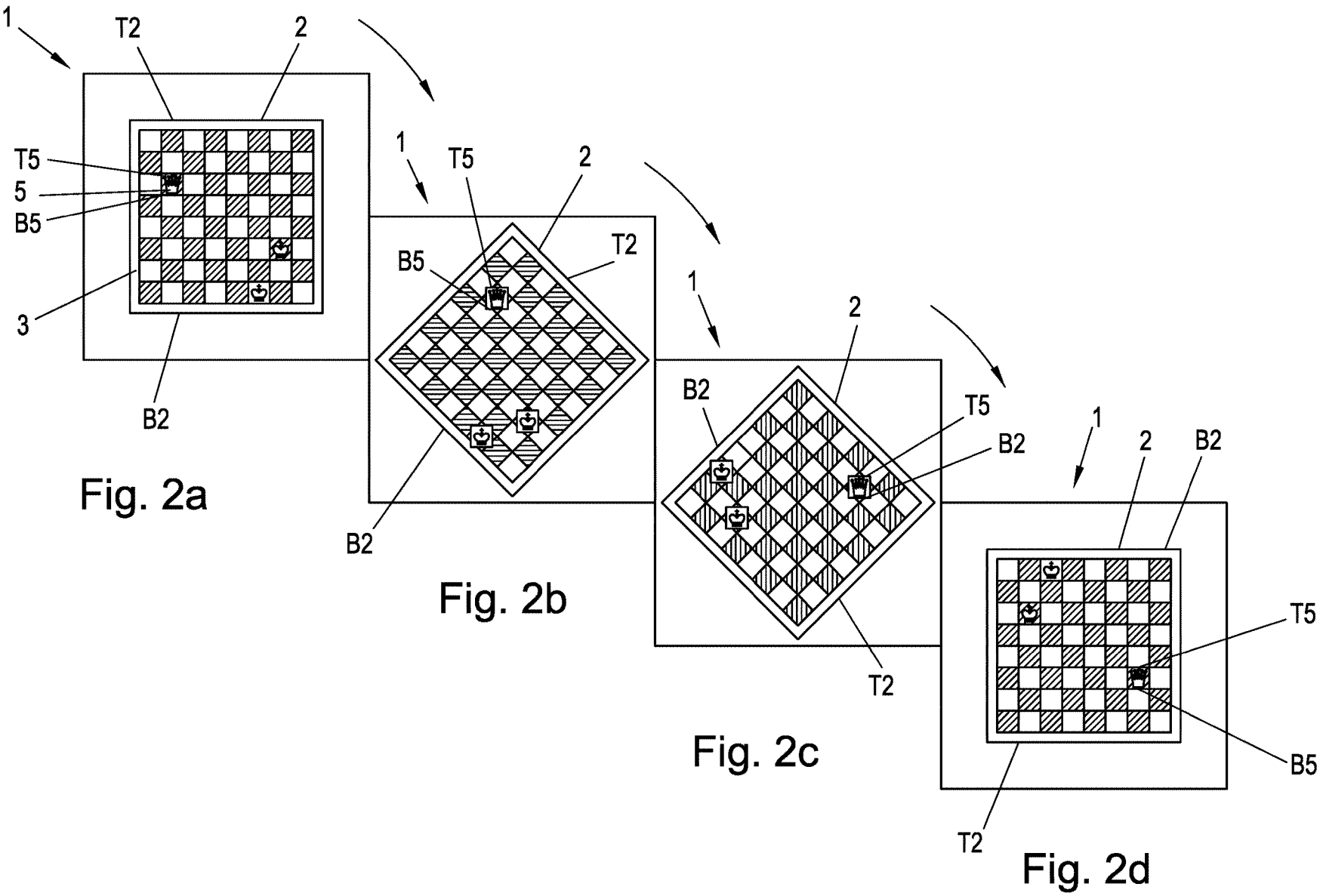
FIGS. 2*a* to 2*d* illustrate the board of FIG. 1 with playing pieces in different rotated positions of the board.

FIGS. 2*a* to 2*d* illustrate the rotation of the board 2, oriented vertically in this example, in order to arrange it upside down and the rotation of playing pieces 5 with respect to the board 2 in order to hold the playing pieces 5 arranged on assigned playing fields 4 in a same, unmodified vertical orientation. In particular FIG. 2*a* shows board 2 in a starting position, FIG. 2*b* the board 2 in an orientation after rotating it by 60°, FIG. 2*c* the board 2 in an orientation after rotating it by another 60° and FIG. 2*d* the board 2 in an orientation after rotating it by 180° compared to the starting position, in which FIG. 2*d* the board 2 is oriented upside down. As can be seen, the playing pieces 5 keep their vertical orientation for any rotation of board 2.

Figures 3A, 3B, 4A, 4B, 5A, 5B, 8, 9:
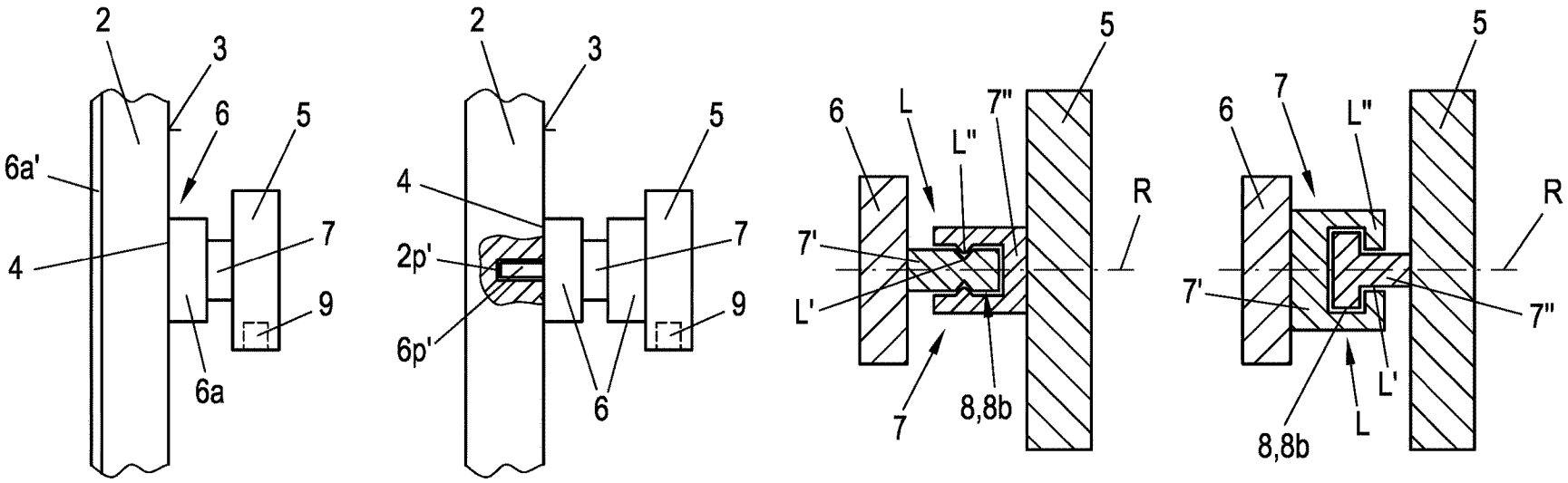
FIG. 3*a*, 3*b* illustrate a simple illustration of the board, a holding device, a rotating device and a playing piece each.
FIG. 4*a*, 4*b* illustrate an arrangement of a holding device and a rotating device each, the rotating device being attached to the playing piece.
FIG. 5*a*, 5*b* illustrate an arrangement of a holding device and a rotating device each, the rotating device being arranged within the playing piece.
FIG. 8 illustrates a holding device comprising an adhesive element and being attached on the board.
FIG. 9 illustrates a holding device which comprises hook and loop fastener on a playing piece and on the board.

FIG. 3*a* shows in a simplified illustration a part of the board 2, a holding device 6, e.g. comprising a magnet 6*a*, a rotating device 7 and one playing piece 5. The playing piece 5 is connected directly to the rotating device 7 in order to rotate with respect to the holding device 6, which is connected directly to rotating device 7 and held releasably on the playing surface 3 of the board 2. Board 2 may comprise a part of holding device 6, e.g. a metal plate 6*a*'. The weight element 9 may be fully accommodated within playing piece 5 or attached thereto.

FIG. 3*b* shows a part of the board 2, two holding devices 6, a rotating device 7 in between the holding devices 6 and one playing piece 5, illustrating that the playing pieces 5 may be connected directly to at least a part of the holding device 6. In FIG. 3*b* the holding device 6 comprises a pin 6*p*' which can be inserted into a bore hole or sleeve 2*p*', arranged in board 2, for holding playing piece 5 at playing field 4.

FIGS. 4*a* and 4*b* show different arrangements of a holding device 6 and a rotating device 7, comprising a radial bearing 8*b*, which rotating device 7 comprises a part 7' fixed to the holding device 6 and a rotating part 7" connected to the playing piece 5 and rotating about a rotation axis R. For holding the parts 7', 7" together, a latch L comprising a web L" on the rotating part 7" engaging a groove L' in the fixed part 7', or vice versa, or any other means, may be provided. In FIG. 4*a* the rotating part 7" rotates around the fixed part 7' while in FIG. 4*b* the rotating part 7" rotates within the fixed part 7'. In any case, the centre of gravity of all rotating components connected to or part of the rotating part 7", including the playing piece 5, does not coincide with the rotation axis R in order to hold the playing piece 5 in a same vertical orientation by gravity. FIGS. 4*a* and 4*b* show the rotating device 7 attached to the playing piece 5, i.e. external the playing piece 5.

In embodiments shown in FIGS. 5*a*, 5*b* rotating device 7 is arranged within playing piece 5. Rotating device 7 comprises a radial bearing 8*b* with a pin 8*b*' rotating in a bore hole 8*b*" or in a sleeve 8*b*'".

Figure 6:
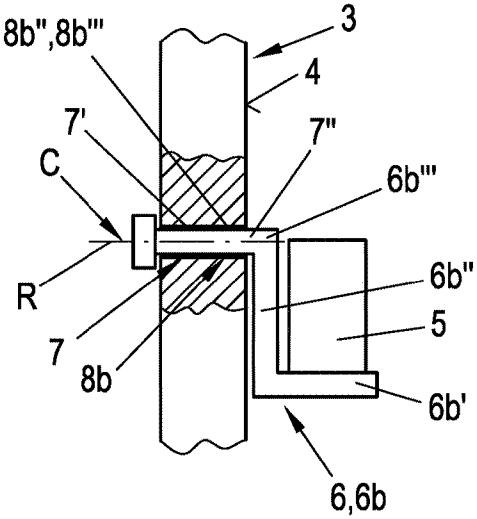
FIG. 6 illustrates a schematic side view of a rotating device arranged on the board.

FIG. 6 shows a schematic side view of rotating device 7 arranged on board 2, wherein only a part of board 2 associated with a playing field 4 is illustrated. The rotating device 7 comprises a fixed part 7' in the playing field 4 of board 2 and a rotating part 7" rotating within the fixed part 7'. Furthermore the rotating device 7 builds or comprises a radial bearing 8*b* with a bore hole 8*b*" or a sleeve 8*b*'" in board 2. The rotating part 7" is connected to or part of a z-shaped holding device 6*b* which is arranged on board 2 only. As can be seen best in FIG. 6, holding device 6*b* comprises a horizontal platform 6*b*' for supporting a playing piece 5, which horizontal platform 6*b*' is connected to the playing field 4 of the vertically oriented board 2 via a vertical, second leg 6*b*" and a horizontal, first leg 6*b*'". The horizontal leg 6*b*'" is arranged at the centre C of playing field 4, located on rotation axis R, in rotating manner.

Figure 7B:
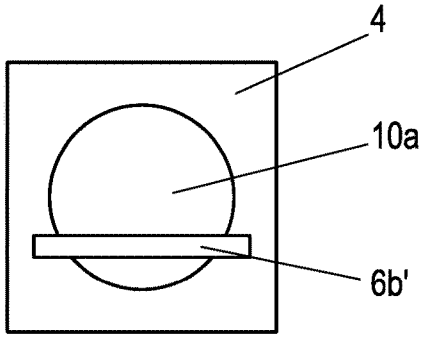
FIG. 7*b* illustrates a schematic front view of a playing field and a rotating device comprising a circular disk accommodated in the board.
Figure 7A:
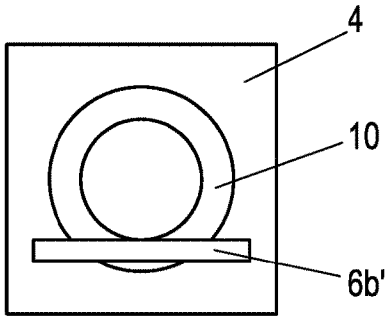
FIG. 7*a* illustrates a schematic front view of a playing field and a rotating device comprising a circular ring accommodated in the board.

FIG. 7*a* shows a schematic front view of a playing field 4. The rotating device 7 comprises a circular ring 10 accommodated in a part of board 2 associated with the playing field 4 in rotating manner. The circular ring 10 is accommodated within a groove in playing field 4 and board 2. A horizontal platform 6*b*' of holding device 6 is connected to the circular ring 10. As in the embodiment shown in FIG. 6 a playing piece 5 (not illustrated in FIG. 7) may be placed on the horizontal platform 6*b*'.

FIG. 7*b* shows a schematic front view of a playing field 4 in which the rotating device 7 comprises a circular disk 10*a*, instead of a circular ring 10, accommodated in a part of board 2 associated with the playing field 4 in rotating manner.

In the embodiments shown in FIGS. 7*a* and 7*b* the horizontal platform 6*b*' could be omitted and the playing piece 5 could be releasably connected to the circular ring 10 or circular disk 10*a* directly.

FIG. 8 illustrates a holding device 6 which, when the playing piece 5 is not arranged on board 2, is arranged on the playing piece 5 only, e.g. via rotating device 7, i.e. board 2 does not comprise any part of holding device 6. For instance the holding device 6 comprises an adhesive element 11.

FIG. 9 shows a holding device 6 which comprises hook and loop fastener 12', 12" on a playing piece 5 and on board 2, in particular on playing field 4.

Figure 10C:
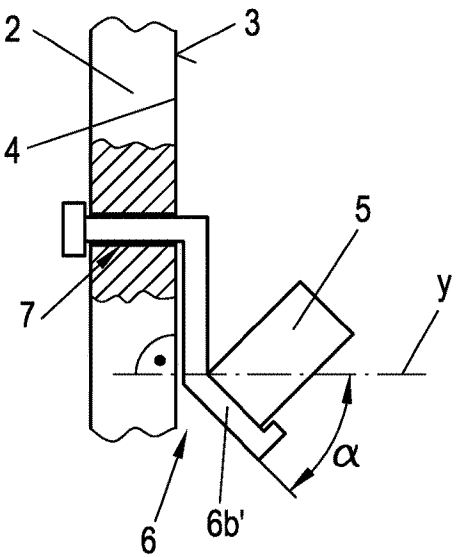
FIGS. 10*a* to 10*c* illustrate embodiments for holding a playing piece at an angle different to 0° between its vertical axis and the playing surface.
Figure 10B:
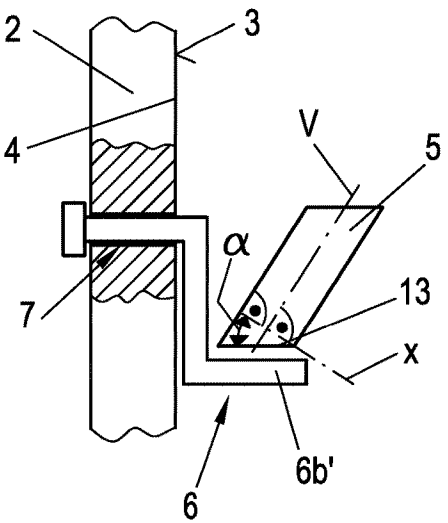
Figure 10A:
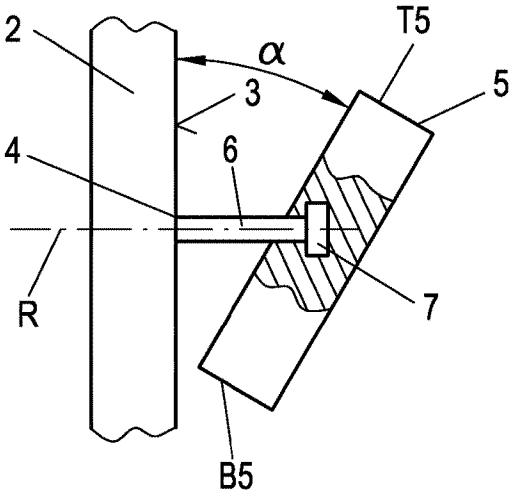

FIGS. 10*a* to 10*c* show embodiments for holding a playing piece 5 at an angle α different to 0° between its vertical axis V and playing surface 3. According to FIG. 10*a* a playing piece 5 is mounted to holding device 6 in the angular relationship, i.e. the playing piece 5 is mounted to holding device 6 at an angle different to 90°, see the angle α between the playing piece 5 and the playing surface 3. According to FIG. 10*b* the playing piece 5 comprises a base 13 inclined at angle α with respect to an axis X orthogonally to vertical axis V, which inclined base 13 may be placed on the horizontal platform 6*b*' of holding device 6*b*. According to FIG. 10*c* the horizontal platform 6*b*' is arranged non orthogonally to the playing surface 3, i.e. the horizontal platform 6*b*' is tilted at the angle α, with respect to an axis Y orthogonally to playing surface 3. Of course the angle α may be negative as well in the embodiments of FIG. 10*a* to 10*c* so that, differently to the illustration in FIG. 10*a* to 10*c*, the top end T5 of playing piece 5 is closer to the playing surface 3 than the bottom end B5 of playing piece 5. Therefore the angle α is preferably between −45° and +45°, more preferred between −30° and +30°.

FIG. 11 shows a playing piece 5 built of two halves 5', 5" separable from and connectable with each other along a vertical mid-plane P of the playing piece 5. One of the two halves 5', 5" comprises a holding device 6, for being attached to board 2, and a rotating device 7 and therefore represents the playing piece 5 to be held in a same vertical orientation. For re-connecting the halves 5', 5", if desired, they comprise one or more cooperating connecting elements 14', 14".

FIG. 12 shows a rotating device 7 with a clamping element 15 for connecting a playing piece 5 (not shown in FIG. 12) removably to rotating device 7. The rotating device 7 might be fixed to the board 2 or might be removable from the board 2.

Figure 13A:
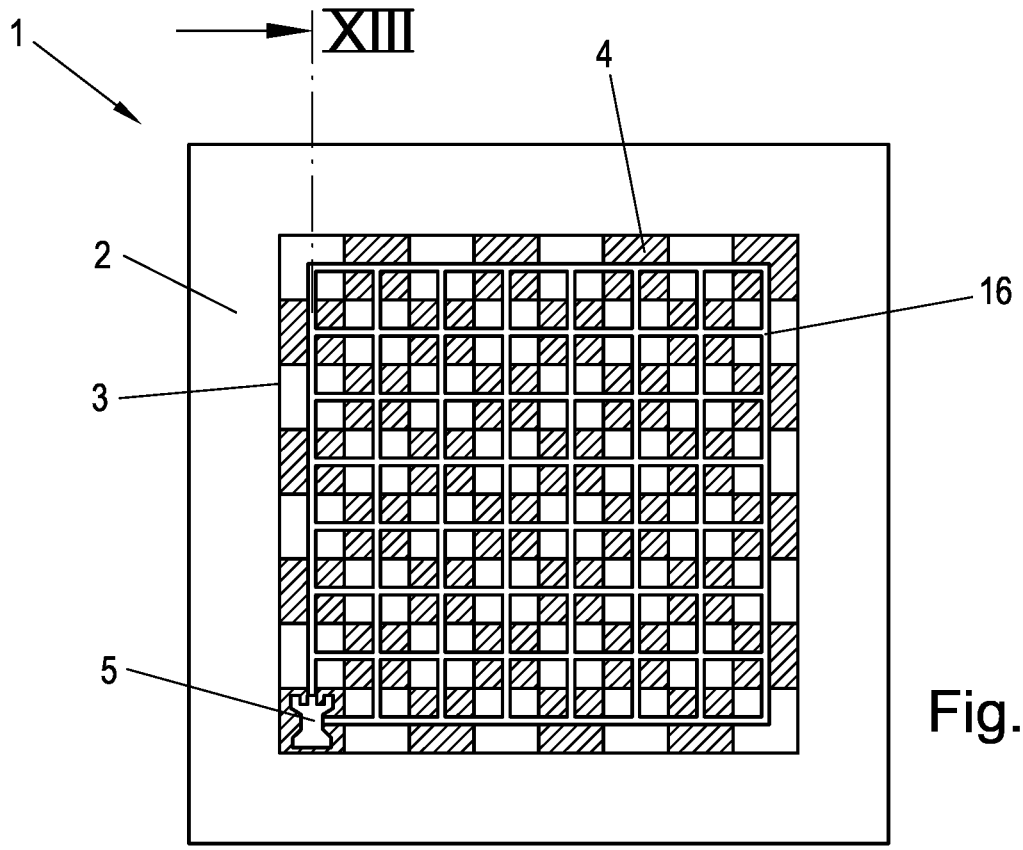
FIG. 13*a* illustrates a board designed to avoid removement of the playing pieces.
Figure 13B:
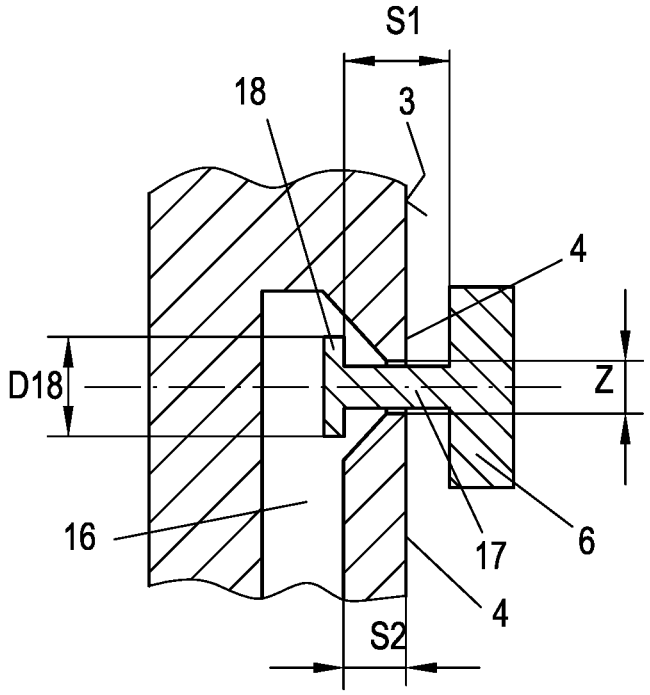
FIG. 13*b* illustrates a sectional view along line XIII in FIG. 13*a;*

FIG. 13*a* illustrates a board 2 designed to avoid removement of the playing pieces 5. Board 2, at the playing surface 3, comprises channels 16 along which the playing pieces 5 can be moved. As can be seen in FIG. 13*b*, which represents a sectional view along line XIII in FIG. 13*a*, holding device 6 comprises a pin 17 engaging the channels 16, with a counter element 18 at an end of pin 17. In order to avoid removement of playing pieces 5, diameter D18 of counter element 18 is larger than the width Z of the channels 16 at the playing surface 3. The length S1 of pin 17 is larger than the distance S2 between playing surface 3 and the channels 16 to allow movement of playing pieces 5 with some clearance between playing surface 3 and holding device 6.

Figure 13D:
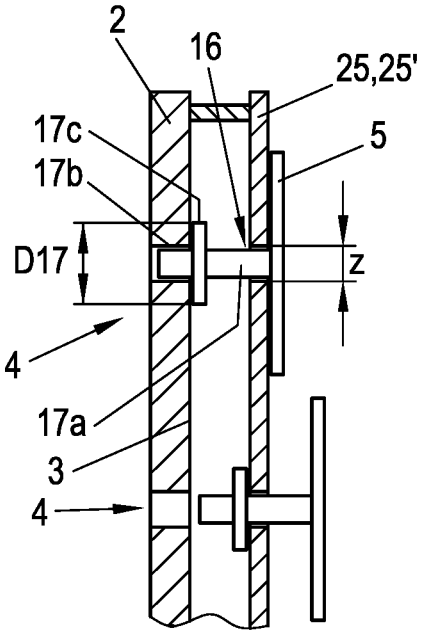
FIG. 13*d* illustrates a sectional view along line XIIIc in FIG. 13*c;*
Figure 13C:
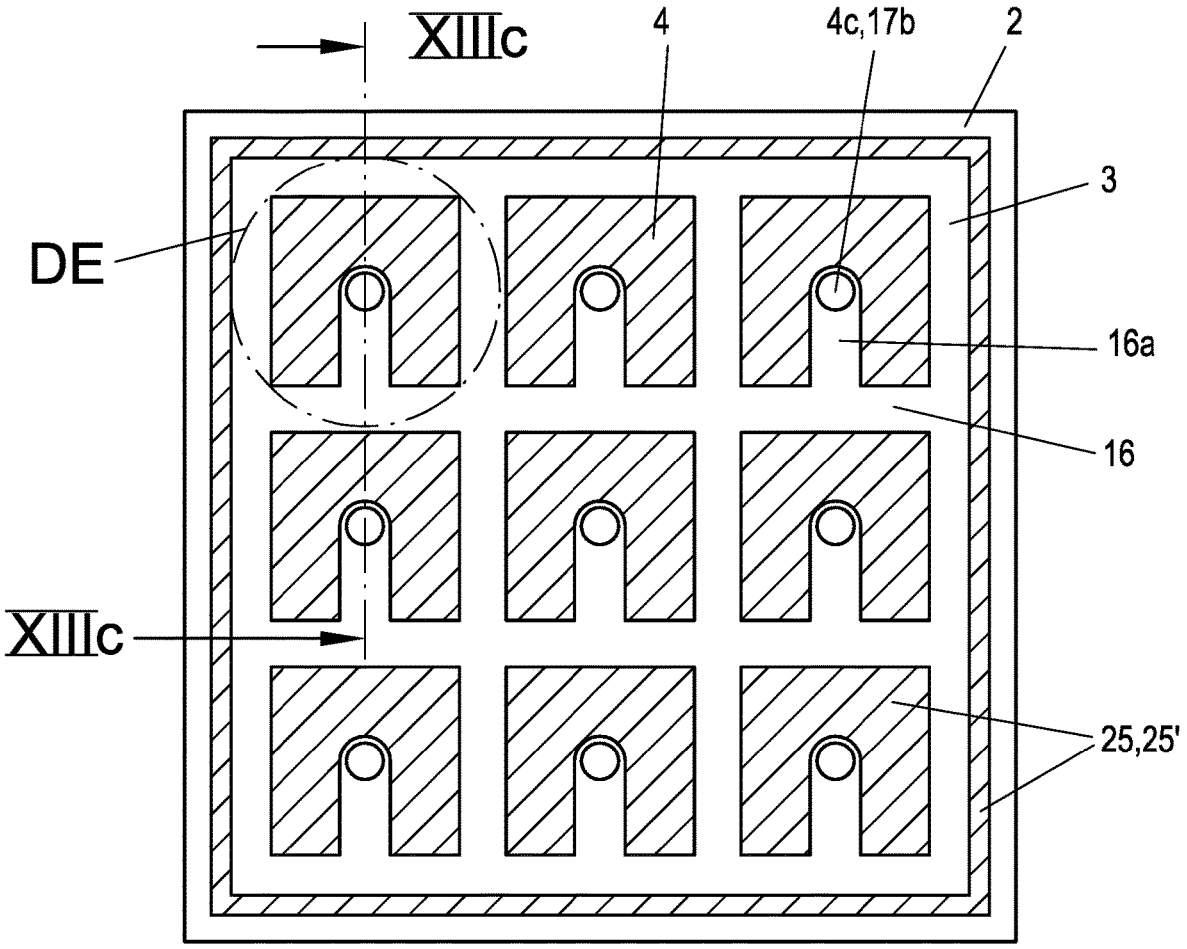
FIG. 13*c* illustrates another embodiment of a board designed to avoid removement of the playing pieces.

FIG. 13*c* illustrates another embodiment of a board 2 designed to avoid removement of the playing pieces 5. Again channels 16 are provided along which the playing pieces 5 can be moved. However in contrast to FIG. 13*a* the channels 16 extend between the playing fields 4 alongside their edges and comprise an extension 16*a* into each playing field 4, in particular to the centre 4*c* of each playing field 4. A hole or sleeve 17*b* may be arranged at the centre 4*c* for accommodating an end of a pin 17*a* of a holding device 6. The channels 16 may be provided within a layer 25 preferably of transparent material, e.g. within a glass plate 25', which is arranged in front of and with distance to the playing surface 3.

FIG. 13*d* shows a sectional view along line XIIIc in FIG. 13*c*. The board 2 comprises the hole or sleeve 17*b* for accommodating the pin 17*a* which can be moved within the channels 16. As the pin 17*a* comprises a thickened part 17*c*, whose diameter D17 is larger than the width Z of channel 16, the playing piece 5 connected to pin 17*a* can not be pulled out completely of the layer 25.

Figure 13E:
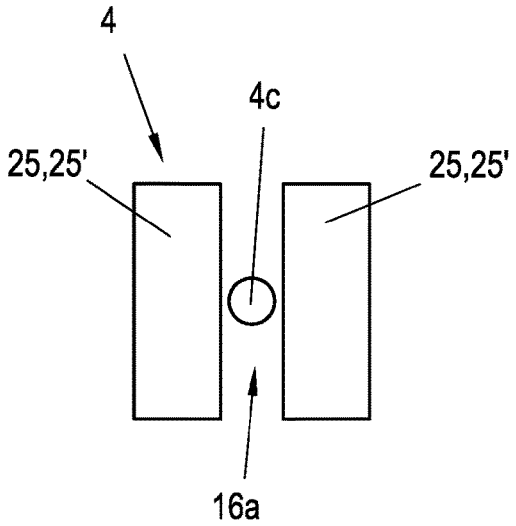
FIG. 13*e* and FIG. 13*f* illustrate other embodiments of parts of a board designed to avoid removement of the playing pieces.

FIG. 13*e* illustrates an alternative embodiment of detail DE of FIG. 13*c*, showing the extension 16*a* leading to the centre 4*c* of playing field 4. In particular the extension 16*a* is provided from two opposite edges of the playing field 4 to the centre 4*c*, splitting the layer 25 in two halves.

Figure 13F:
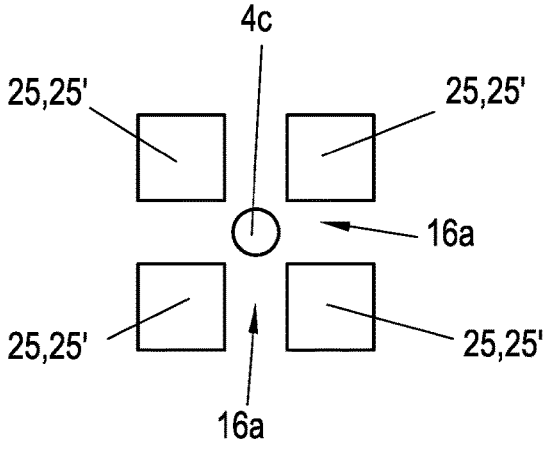

FIG. 13*f* illustrates an other alternative embodiment of detail DE of FIG. 13*c* in which the extension 16*a* is provided from four edges of the playing field 4 to the centre 4*c*, splitting the layer 25 in four quarters.

Figure 14:
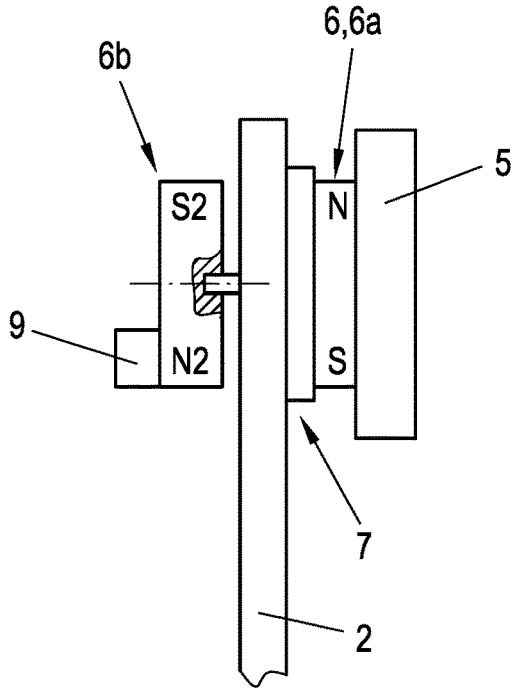
FIG. 14 illustrates another assembly of the board, a holding device, a rotating device and a playing piece.

FIG. 14 shows an alternative assembly of the board 2, holding device 6, rotating device 7 and playing piece 5. The holding device 6 comprises a magnet 6*a* having a north pole N an a south pole S which magnet 6*a* is connected rotatably to board 2 at the front side of board 2, i.e. the side of the playing surface 3, via rotating device 7. Opposite the front side, i.e. at the back side of board 2, a second magnet 6*b* having a north pole N2 an a south pole S2 is connected rotatably to board 2. As the second magnet 6*b* comprises a weight element 9 it always keeps the same vertical orientation, independent of the orientation of the board 2. In addition as the north pole N/south pole S of magnet 6*a* is positioned opposite to south pole S2/north pole N2 of magnet 6*b* magnetic forces between magnet 6*a* and magnet 6*b* will keep the playing piece 5 in a same vertical orientation as well, independent of the orientation of board 2.

Figure 15:
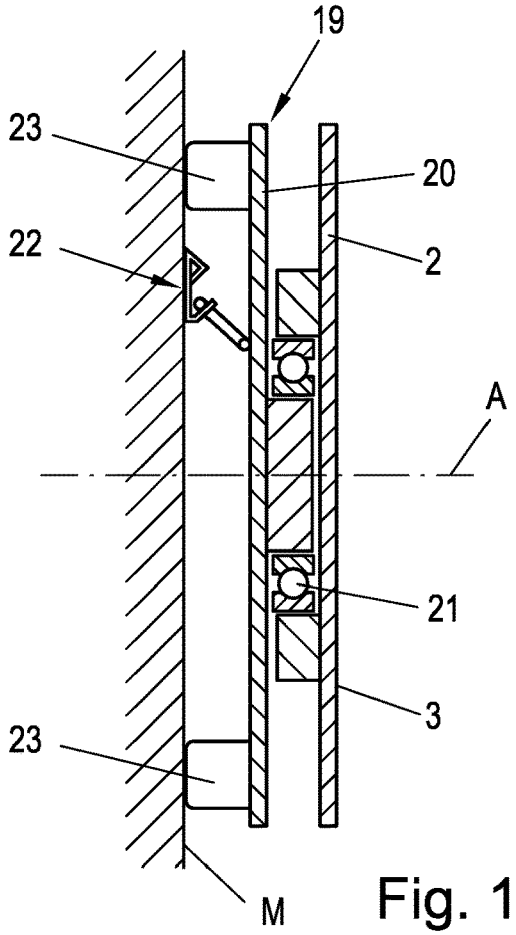
FIG. 15 illustrates exemplary fastening means comprising a supporting device and a second rotating device.

FIG. 15 shows exemplary fastening means 19 comprising a supporting device 20 mounted to a wall M and comprising a second rotating device 21 connecting board 2 to supporting device 20 in rotatable manner. The supporting device 20 may be held on wall M by at least one hook connection 22. Optional spacers 23 guarantee some distance between supporting device 20 and wall M. Because of the second rotating device 21, which may for instance comprise a ball bearing, board 2 can be rotated on supporting device 20 easily.

Figure 16A:
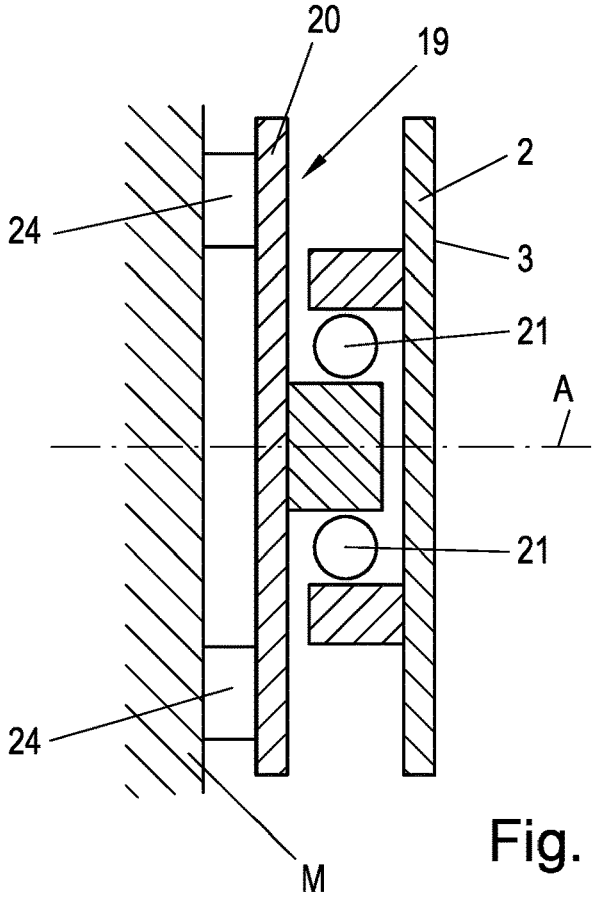
FIG. 16*a* illustrates a fastening means comprising at least one magnetic element on the supporting device.

FIG. 16*a* shows a fastening means 19 comprising at least one magnetic element 24 on supporting device 20 for holding supporting device 20 on a vertical wall M of metal.

Figure 16B:
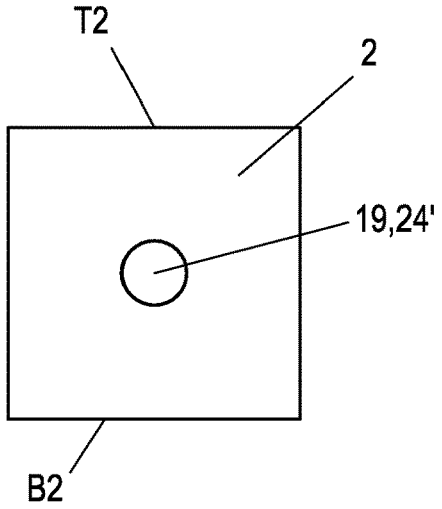
FIG. 16*b* illustrates the back side of the board with fastening means comprising at least one magnetic element.

FIG. 16*b* shows the back side of board 2 with fastening means 19 comprising at least one magnetic element 24'. If only one magnetic element 24' is provided on the backside of board 2, rotation of board 2 on a wall of metal is facilitated.

Figure 17A:
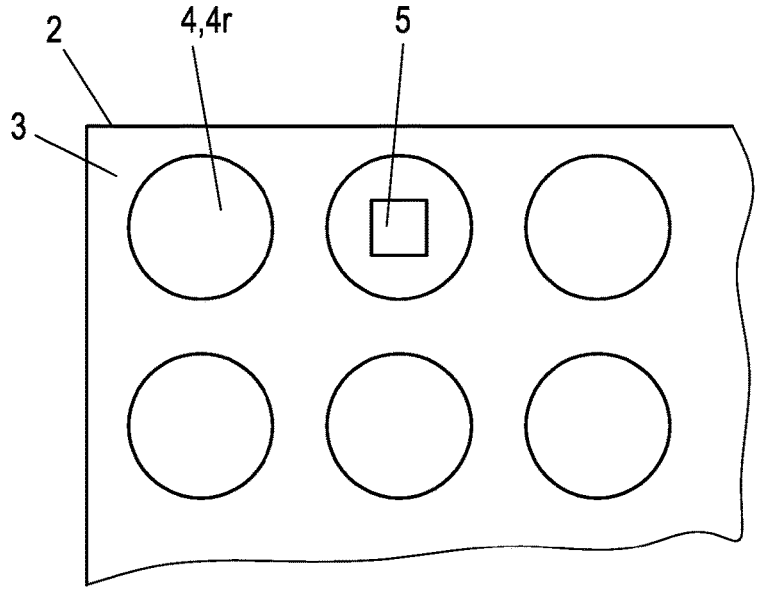
FIG. 17*a* illustrates a schematic front view of a board with rotatable playing fields of circular design.

FIG. 17*a* shows a schematic front view of a board 2 with rotatable playing fields 4 of circular design. The playing fields 4 are connected to board 2 by rotating device 7 and they may rotate in the plane defined by playing surface 3 or at some distance to this plane. The playing piece 5 may be releasably connected to the respective playing field 4 by holding device 6. The rotatable playing fields 4 shall not touch each other.

Figure 17B:
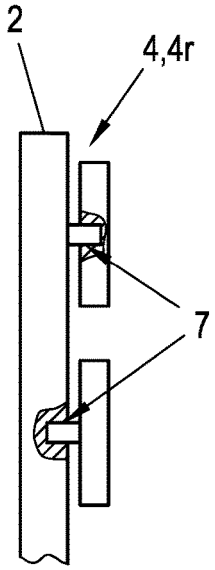
FIG. 17*b* illustrates a side view of the board illustrated in FIG. 17*a;*

FIG. 17*b* illustrates the assembly of FIG. 17*a* comprising a part of board 2, rotating devices 7 and the rotatable playing fields 4 in a side view.

Figure 18A:
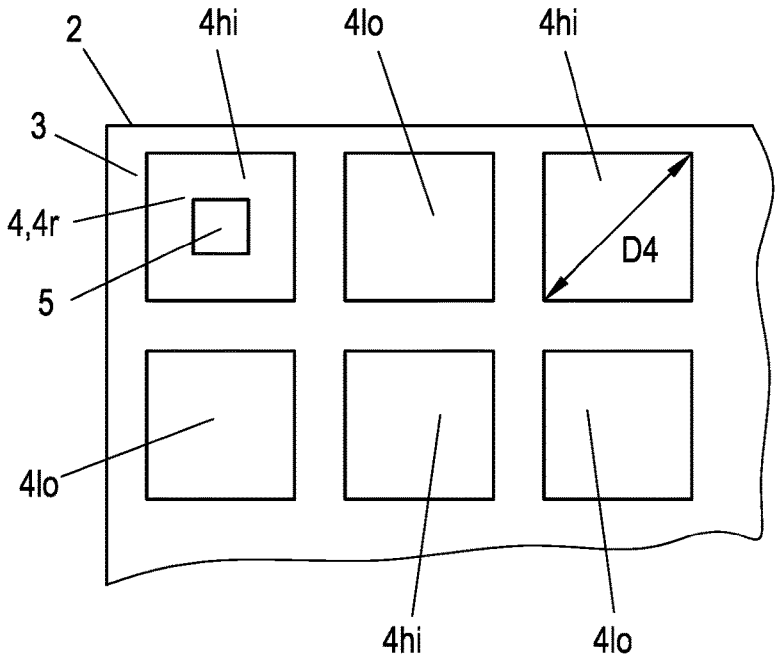
FIG. 18*a* illustrates a schematic front view of a board with rotatable playing fields of squared design.

FIG. 18*a* shows a schematic front view of a board 2 with rotatable playing fields 4 of squared design. Again the playing fields 4 are connected to board 2 by rotating device 7 and they may rotate in the plane defined by playing surface 3 if they are of a size small enough not to touch each other when rotating, or they may rotate at some distance to this plane. In particular adjacent playing fields 4, i.e. playing fields 4*hi*, 4*lo* which are closest to each other, may be arranged at different distances to board 2. For instance the playing fields 4*hi* may be arranged at a larger distance to board 2 than the playing fields 4*lo*. The playing piece 5 may be releasably connected to the respective playing field 4 by holding device 6.

Figure 18B:
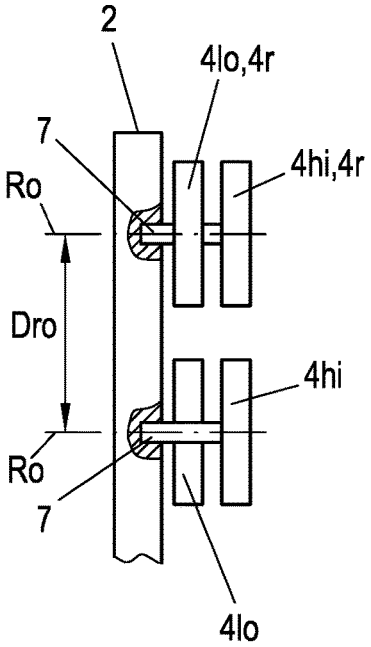
FIG. 18*b* illustrates a side view of the board illustrated in FIG. 18*a;*

FIG. 18*b* illustrates the assembly of FIG. 18*a* comprising a part of board 2, rotating devices 7 and the rotatable playing fields 4*hi*, 4*lo*, arranged at different distances to board 2 in a side view. The rotation axes Ro of the playing fields 4 closest to each other are arranged at a distance Dro. The playing fields 4 comprise a diagonal extension D4.

FIG. 19*a* shows a schematic front view of a board 2 rotated about a physical axis Ph offset from an imaginary middle axis A of the board 2.

FIG. 19*b* shows a schematic front view of a board 2 without a physical axis for rotation. Instead the board 2 can be taken off a wall M rotated as needed and fixed to wall M again. In FIG. 19*b* the board 2 ends up upside down. The board 2 may comprise fastening elements 26 for attaching it to the wall M.

The invention claimed is:

1. A chess game comprising:

a chess board having a playing surface with multiple playing fields, wherein the chess board is oriented so that the playing surface deviates from a horizontal plane and the chess board is rotatable about an imaginary axis substantially orthogonal to the playing surface;

chess pieces for each player that are releasable from the multiple playing fields and placeable on different playing fields on the playing surface;

at least one holding device, which is coupled to at least one of the multiple playing fields or chess pieces, releasably attaching one of the chess pieces to one of the multiple playing fields and holding the one of the chess pieces on the one of the multiple playing fields for any rotation of the chess board about the imaginary axis, wherein the one of the chess pieces has a top end and a bottom end, a rotating device configured to rotate the one of the chess pieces that is releasably attached by the at least one holding device to the one of the multiple playing fields so that, for any rotation of the chess board about the imaginary axis, the top end of the one of the chess pieces that is releasably attached by the at least one holding device to the one of the multiple playing fields, with respect to gravity, is located above the bottom end, wherein the rotating device comprises:

a rotating part, which is rotatable about a rotation axis, is-connected to one of: the one of the chess pieces, the at least one holding device or the one of the multiple playing fields of the chess board; and a bearing for rotating the rotating part, and wherein a center of gravity of at least one of the at least one holding device and the one of the chess pieces, which is connected to the rotating part, does not coincide with the rotation axis of the rotating part, whereby the one of the chess pieces maintains an orientation in which the top end of the chess piece is located, with respect to gravity, above the bottom end of the playing piece.

2. The chess game according to claim 1, wherein at least one of the one of the chess pieces, the at least one holding device and the rotating device comprises a weighted element.

3. The chess game according to claim 1, wherein the rotating device is one of arranged within or attached to the one of the chess pieces.

4. The chess game according to claim 1, wherein the rotating device is arranged on or within the chess board.

5. The chess game according to claim 4, wherein the rotating device comprises one of a bore hole or a sleeve in the one of the multiple playing fields.

6. The chess game according to claim 4, wherein the rotating device comprises one of a circular ring or a circular disk accommodated in a rotating manner in a part of the chess board associated with the one of the multiple playing fields.

7. The chess game according to claim 6, wherein the holding device comprises a platform for supporting the one of the chess pieces, and wherein the platform of the at least one holding device is connected to the one of the circular ring or the circular disk of the rotating device.

8. The chess game according to claim 1, wherein the at least one holding device is arranged on the one of the chess pieces.

9. The chess game according to claim 8, wherein the at least one holding device is arranged on the one of the chess pieces by one of an adhesive element, an electrostatically loaded element or a suction cup.

10. The chess game according to claim 1, wherein the at least one holding device is arranged on or in the one of the chess pieces and is connectable to the one of the multiple playing fields, and wherein the at least one holding device comprises one of:

a magnet or a magnetizable element connected to the one of the chess pieces to interact with a magnetizable element or magnet connected to the one of the multiple playing fields, a hook and loop fastener connected to the one of the chess pieces and on the one of the multiple playing fields, or a pin, which is connected to one of the one of the chess pieces or the one of the multiple playing fields, that is insertable into one of a bore hole or a sleeve in the other one of the one of the multiple playing fields or the one of the chess pieces.

11. The chess game according to claim 1, wherein the at least one holding device is arranged on or in the one of the multiple playing fields and wherein the at least one holding device, which comprises a platform for supporting the one of the chess pieces, is connectable to the one of the multiple playing fields so that the platform is oriented at a non-zero angle to a surface orthogonal to the one of the multiple playing fields.

12. The chess game according to claim 11, wherein the platform of the at least one holding device is connected to a first leg via a second leg, the first leg and second leg forming the rotating part, and wherein the first leg is arranged in the bearing formed by one of a bore hole or a sleeve in the one of the multiple playing fields.

13. The chess game according to claim 1, wherein the one of the multiple playing fields is a rotatable element, which is connected to the chess board by the rotating device.

14. The chess game according to claim 1, wherein the bearing comprises a radial bearing.

15. The chess game according to claim 14, wherein the radial bearing comprises a pin rotating in one of a bore hole or a sleeve.

16. The chess game according to claim 1, wherein the playing surface of the board is vertically oriented.

17. The chess game according to claim 1, wherein the chess board is configured to be rotated 180° around the imaginary axis after each player's turn and before a next player's turn.

18. The chess game according to claim 1, wherein the one of the chess pieces has a vertical axis extending from the top end to the bottom end, and the one of the chess pieces is held by the at least one holding device so that the vertical axis is held at an angle different to 0° to the playing surface.

19. A board game comprising:

a board having a playing surface with multiple playing fields, wherein the board is oriented so that the playing surface deviates from a horizontal plane and the board is rotatable about an imaginary axis substantially orthogonal to the playing surface;

game pieces for each player that are releasable from the multiple playing fields and placeable on different playing fields on the playing surface;

at least one holding device, which is arranged on or in one of the multiple playing fields, releasably attaching one of the game pieces to the one of the multiple playing fields, and holding the one of the game pieces on the one of the multiple playing fields for any rotation of the board about the imaginary axis, wherein the one of the game pieces has a top end and a bottom end, and a rotating device configured to rotate the game piece that is releasably attached by the at least one holding device to the one of the multiple playing fields so that, for any rotation of the board about the imaginary axis, the top end of the one of the game pieces that is releasably attached by the at least one holding device to the one of the multiple playing fields, with respect to gravity, is located above the bottom end, wherein the at least one holding device, which comprises a platform for supporting the one of the game pieces, is connectable to the one of the multiple playing fields so that the platform is oriented at a non-zero angle to a surface orthogonal to the one of the multiple playing fields, wherein the platform of the at least one holding device is connected to a first leg via a second leg, the first leg being at least part of a rotating part of the rotating device and being arranged in a bearing of the rotating device formed by one of a bore hole or a sleeve in the one of the multiple playing fields, and wherein the first leg is arranged at a center of the one of the multiple playing fields.

* * * * *